United States Patent [19]

Lupton et al.

[11] 3,954,509

[45] May 4, 1976

[54] METHOD OF PRODUCING LOW EXPANSION ALLOYS

[75] Inventors: David Francis Lupton, Birmingham; John Jefferson Mason, Willenhall; Peter John Penrice, Birmingham, all of England

[73] Assignee: The International Nickel Company, Inc., New York, N.Y.

[22] Filed: Aug. 11, 1975

[21] Appl. No.: 603,288

Related U.S. Application Data

[60] Division of Ser. No. 517,960, Oct. 25, 1974, which is a continuation-in-part of Ser. No. 466,286, May 2, 1974, abandoned.

[52] U.S. Cl. ..... 148/3; 148/13.1; 148/14; 148/38

[51] Int. Cl.[2] ..... C21D 6/00; C22D 1/10

[58] Field of Search ..... 75/122, 123 K, 123 J, 75/128 B, 128 V, 128 W; 148/31, 38, 3, 13.1, 14

[56] References Cited

UNITED STATES PATENTS

| | | | |
|---|---|---|---|
| 1,106,207 | 8/1941 | Guillaume | 75/171 |
| 1,454,473 | 5/1923 | Guillaume | 75/171 |
| 2,266,481 | 12/1941 | Talbot | 148/31 |
| 2,610,912 | 9/1952 | Millis | 75/123 K |
| 3,488,186 | 1/1970 | Decker et al. | 75/128 B |
| 3,516,824 | 6/1970 | Gottlieb et al. | 75/128 B |
| 3,532,491 | 10/1970 | Floreen et al. | 75/123 K |

*Primary Examiner*—L. Dewayne Rutledge
*Assistant Examiner*—Arthur J. Steiner
*Attorney, Agent, or Firm*—Miriam W. Leff; Ewan C. MacQueen

[57] ABSTRACT

A process for producing carbidic low expansion alloy which is especially useful as a cast structure requiring close dimensional tolerances is comprised of about 21 to about 55% nickel, up to about 18% cobalt, from about 0.3 to about 2.5% carbon, up to about 3% chromium, from about 0.2 to about 1.2% vanadium, up to about 3% molybdenum, up to about 2% zirconium, niobium and tungsten, and the balance essentially iron, with the provisos:

$\% Ni + 0.75 (\% Co) = 30.5$ to 55, $Cr + Mo + V + Zr + Nb + W = 1$ to 4

$Ni : Fe \geqslant 0.4:1$.

5 Claims, No Drawings

METHOD OF PRODUCING LOW EXPANSION ALLOYS

This is a division, of application Ser. No. 517,960, filed Oct. 25, 1974 which in turn is a CIP of application Ser. No. 466,286, filed May 2, 1974, now abandoned.

BACKGROUND OF THE INVENTION

This invention relates to austenitic low expansion alloys, and more particularly to austenitic nickel-iron or nickel-iron-cobalt alloys having in cast form a low thermal expansion coefficient together with good tensile strength at service temperatures.

It is well known that certain austenitic alloys of nickel and iron possess unusual thermal expansion characteristics. For example, an austenitic alloy of 36% nickel and 64% iron has a coefficient of thermal expansion approaching zero between the temperatures of 0°C and around 200°C. Such known nickel-iron alloys, however, have low strength, and it is also known to strengthen these alloys, for use in wrought form, with additions of an element such as titanium which forms an intermetallic compound precipitate when the wrought alloy is given an ageing heat treatment. However, as is also well known, the increase in strength resulting from such additions is achieved at the expense of the low coefficient of thermal expansion which tends to be undesirably increased with increase in strength and this undesirable effect would be expected to be even more marked for the alloy in cast form than for the alloy in wrought form.

It is now proposed to strengthen low expansion austenitic nickel-iron (-cobalt) alloys, for use in case form, by the addition of carbide forming elements. Normally additions to nickel-iron alloys of carbide forming elements such as, for example, carbon, chromium, molybdenum would be expected significantly to increase the low thermal expansion coefficient attainable in nickel-iron alloys. Surprisingly it has now been found that if the nickel content, or where cobalt is also present, the sum of the nickel and cobalt contents, is maintained within specific limits, additions of carbon and vanadium, which form carbides with carbon, and optionally chromium and/or molybdenum which also form carbides with carbon, can be made which substantially increase the strength of nickel-iron (-cobalt) alloy castings with or without ageing, while at the same time allowing a low thermal expansion coefficient to be largely maintained.

It is an object of the present invention to provide nickel-iron or nickel-iron-cobalt alloys having in the cast condition a low thermal expansion coefficient and good tensile strength.

It is another object of this invention to provide a low expansion alloy which can be cast as a structural component requiring close dimensional tolerances under varying temperature conditions.

It is a further object to provide a low-expansion alloy with good strength and suitable for investment casting into complex structures, which can be cast in air.

It is still another object to provide a cast structural machine part, including rotating and reciprocal parts such as turbine blades and shafts, which operate in close proximity to other machine parts and require dimensional stability and good tensile strength over varying temperatures up to about 300°C or higher, e.g., up to about 500° or 600°C.

These and other objects and advantages will become apparent from the following description of the invention and the examples.

THE INVENTION

According to one aspect of the present invention there is provided a high-strength low expansion alloy consisting essentially of, by weight, from about 21 to about 55% nickel, from 0 to about 18% cobalt, from about 0.3 to about 2.5% carbon, from 0 to about 3% chromium, from 0.2 to 1.2% vanadium, from 0 to 3% molybdenum, from 0 to about 0.5% aluminum, from 0 to about 0.5% silicon, from 0 to about 2% manganese, from 0 to about 2% zirconium, from 0 to about 2% niobium, from 0 to about 2% tungsten, from 0 to about 0.1% magnesium, from 0 to about 0.05% calcium, and from 0 to about 0.2% in total of one or more of yttrium, lanthanum and the lanthanides, with the provisos that the sum of the chromium, molybdenum, vanadium, zirconium, niobium and tungsten contents is in the range of from 1 to 4%, the sum of $$\% \text{Ni} + 0.75\ (\% \text{Co}) = 30.5 \text{ to } 55,$$

and the nickel to iron ratio is equal to or greater than 0.4:1, the balance, apart from impurities, being essentially iron. Preferably the nickel to iron ratio should be equal to or greater than 0.45:1.

According to another aspect of this invention there is provided a shaped casting having a predominantly austenitic structure made from the high-strength low expansion alloy of this invention.

In these alloys the nickel content preferably does not exceed 43%, the sum of %Ni + 0.75 (%Co) is from about 31.5 to about 43, the chromium content is from about 0.1 to about 1% or is at least 1%, the carbon content does not exceed 1%, and the molybdenum content does not exceed 2%. Castings from such alloys will have in the heat treated condition a 0.2% proof stress at 500°C greater than 200 N/mm$^2$ (Newtons per square millimeter) and a coefficient of thermal expansion (defined as change in linear dimension per unit length per degree Celsius) over the temperature range 20° to 350°C not greater than $6.5 \times 10^{-6}$/°C. The expansion characteristics can be met between 20° to 250°C for comparable alloys having a chromium content of at least 1%.

Preferably castings according to the invention are made from alloys consisting essentially of, by weight, from about 26.5 to about 28.5% nickel, from about 13 to about 15% cobalt, from about 0.5 to about 1% chromium, from about 0.45 to about 0.55% carbon, from about 0.4 to about 0.6% vanadium, from about 0.8 to about 1.2% molybdenum, not more than about 0.3% manganese, less than about 0.3% silicon, upon to about 0.25% aluminum, balance essentially iron, and subject to the foregoing provisos.

An alloy particularly suited for use for castings according to the invention consists essentially, by weight, of about 0.5% carbon, about 0.75% chromiun, about 0.5% vanadium, about 1.0% molybdenum, about 0.3% manganese, less than about 0.3% silicon, about 0.2% aluminum, about 14.0% cobalt, about 28.0% nickel, balance essentially iron.

A further alloy particularly suited for use for castings according to the invention consists essentially of by weight, about 0.6% carbon, about 2% chromium, about 0.5% vanadium, about 0.3% silicon, about 0.3% manganese, about 10% cobalt, about 30% nickel, balance essentially iron.

Alloys suitable for use for castings according to the invention may also contain small amounts of phosphorus and boron as impurities such as not more than about 1% phosphorus and/or not more than about 0.25% boron.

were heat treated for 8 hours at 700°C and tested for thermal expansion over the range 20° to 300°C with the results shown in Table 1. In the tables values of the thermal expansion coefficients $\times 10^6$ are tabulated. Thus, for example, the thermal expansion coefficient of Alloy 7, over the range 20° to 300°C is $5.5 \times 10^{-6}$/°C.

TABLE 1

| Alloy | Composition (weight %) | | | | | | | | | | Expansion Coefficient from 20 to 300°C ( $\times 10^6$/°C ) |
|---|---|---|---|---|---|---|---|---|---|---|---|
| | Fe | Co | C | Cr | Mo | V | Ni | Ni+0.75 (Co) | Cr+Mo+V +Zr+Nb+W | Ni/Fe | |
| 1 | 48.81 | 12.89 | 0.58 | 2.11 | 1.02 | 0.48 | 34.1 | 43.76 | 3.61 | 0.70 | 8.9 |
| 2 | 50.13 | 13.68 | 0.52 | 2.09 | 0.99 | 0.45 | 32.4 | 42.66 | 3.53 | 0.65 | 8.5 |
| 3 | 50.79 | 13.76 | 0.48 | 2.07 | 1.06 | 0.44 | 31.4 | 41.72 | 3.57 | 0.62 | 7.8 |
| 4 | 51.36 | 13.99 | 0.50 | 2.06 | 1.02 | 0.47 | 30.6 | 41.07 | 3.55 | 0.60 | 7.4 |
| 5 | 52.42 | 13.98 | 0.50 | 2.11 | 1.03 | 0.46 | 29.5 | 39.97 | 3.60 | 0.56 | 6.6 |
| 6 | 53.19 | 14.07 | 0.50 | 2.06 | 1.03 | 0.45 | 28.7 | 39.23 | 3.54 | 0.54 | 6.0 |
| 7 | 55.18 | 13.12 | 0.52 | 2.04 | 1.05 | 0.48 | 27.6 | 37.44 | 3.57 | 0.50 | 5.5 |

The tensile properties of a casting according to the invention are a function of both the carbon content of the alloy from which the casting is made and the presence and amount in the alloy from which the casting is made of elements which form carbides with carbon. Although castings according to the invention are normally quite strong in the as cast condition, typically giving 0.2% Proof Stress values at 500°C in excess of about 150 N/mm² in comparison with 42% nickel-iron or nickel-iron-cobalt alloys which tested under similar conditions give 0.2% Proof Stress values of about 50 N/mm², and do not require a high temperature ageing treatment, a heat treatment may be beneficial. A heat treatment in the temperature range of about 500° to 900°C, preferably in the range of about 600° to 850°C for a time in the range of from about 1 to 24 hours can beneficially increase the strength and reduce the coefficient of thermal expansion of the alloy from which the casting according to the invention is made. Adequate heat treatment conditions are about 2 to about 4 hours at about 750°C or about 4 hours at about 700°C, and preferred heat treatment conditions are about 8 to about 24 hours at about 700°C or about 2 to about 8 hours at about 750°C. Generally, age hardening can be applied to as-cast alloys, but if desired it can be preceded by solution heating.

Nickel contents above about 55% and below about 21% have a negligible effect on the tensile properties of alloys otherwise suitable for castings according to the invention but nickel contents below about 21% have an adverse effect on the austenitic stability of the alloy. Increasing the nickel content increases the coefficient of thermal expansion as can be seen from the results of the following Example I.

EXAMPLE I

Alloys 1 to 7 having compositions as shown in the following Table 1 were vacuum melted and vacuum cast to castings according to the invention. The castings From the results of Table 1 it can be seen that reduced the nickel content for generally similar alloys reduced the expansion coefficient. In alloys used for castings according to the invention the nickel content is in the range of about 21 to about 55% by weight. Preferably the nickel content does not exceed about 43%, and for ensuring optimum low expansion for cobalt contents of from about 5 to about 18% preferably does not exceed about 35%, for example about 26.5 to about 28.5% or 30%.

Cobalt contents in excess of about 18% also have a negligible effect on the high temperature tensile properties of alloys otherwise suitable for castings according to the invention but increasing the cobalt content decreased the expansion coefficient as can be seen from Example 2.

Example 2

Alloys 8 and 9 having compositions as shown in the following Table 2 were air melted and air cast to castings according to the invention. The castings were heat treated for 8 hours at 700°C and tested in tension at 500°C and for thermal expansion over the range 20° to 300°C with the results shown in Table 2.

TABLE 2

| Alloy | Composition (weight %) | | | | | | | | | | Expansion Coefficient from 20 to 300°C ( $\times 10^6$/°C ) | 0.2% Proof Stress at 500°C (N/mm²) |
|---|---|---|---|---|---|---|---|---|---|---|---|---|
| | Fe | C | Cr | Mo | V | Co | Ni | Ni+0.75 Co | Cr+Mo+V +Zr+Nb+W | Ni/Fe | | |
| 8 | 54 | 0.5 | 2 | 1 | 0.5 | 14 | 28 | 38.5 | 3.5 | 0.52 | 4.9 | 260 |
| 9 | 55.84 | 0.45 | 2.08 | 1 | 0.43 | 0 | 40.2 | 40.2 | 3.51 | 0.72 | 6.7 | 249 |

The results of Table 2 show that the presence of cobalt up to at least 14% results in a lower expansion coefficient than would be the case in the absence of cobalt. In alloys used for castings according to the invention the cobalt content is in the range of 0 to about 18% by weight. Preferably the cobalt content does not exceed about 15%, for example 10% cobalt may be present, and advantageously is in the range of about 13 to about 15%, for example 14%.

To ensure optimum expansion properties over specific temperature ranges it is necessary that the nickel and cobalt contents be optimized and correlated in alloys from which castings according to the invention are made. In such alloys the sum of % Ni + 0.75 (% Co) = 30.5 to 55.

Preferably the % Ni + 0.75 (% Co) sum is in the range of 31.5 to 43. For optimum thermal expansion properties in the as-cast and non-heat-treated condition or in the age hardened condition the alloys used for castings according to the invention preferably should have nickel and cobalt contents correlated as shown in the following Table 3 for the specific service temperature ranges.

TABLE 3

| Temperature Range (°C) | Optimum %Ni + 0.75 (%Co) | Expansion Coefficient ( × $10^6$/°C) |
|---|---|---|
| 20 – 100 | 34.1 – 37.1 | < 5 |
| 20 – 200 | 35.4 – 38.4 | < 6.5 |
| 20 – 300 | 36.6 – 39.6 | < 7.5 |
| 20 – 350 | 37.0 – 40.0 | < 8.5 |
| 20 – 450 | 38.0 – 41.0 | < 10 |

The expansion coefficients given in Table 3 are for the castings in the as-cast and unaged condition. Even lower expansion coefficients can be obtained over the same temperature ranges for the castings in the age hardened condition.

Lowest expansion properties are achieved at the highest cobalt contents. However to maintain the alloys predominantly austenitic in structure, and hence ensure the best low expansion properties, at room temperature the nickel to iron ratio must be greater than or equal to 0.4, and preferably greater than or equal to 0.45. The expansion coefficients given in Table 3 may be further reduced by keeping the cobalt content high subject to the foregoing % Ni + 0.75 (% Co) and Ni/Fe relationships.

The high temperature tensile strength of alloys from which castings according to the invention are made is dependent on both their carbon content and the content of the element or elements which form a carbide or carbides with carbon. The effects of increasing carbon content with a fixed chromium content and of increasing the chromium content with a fixed carbon content are shown by the following Example 3.

EXAMPLE 3

Alloys 10 to 15 having compositions as shown in the following Table 4 were melted and cast in air to castings according to the invention. The castings were heat treated for 24 hours at 700°C, tensile tested at 500°C, and tested in thermal expansion over various temperature ranges with the results shown in Table 4.

TABLE 4

| Alloy | Composition (Weight %) | | | | | | | | | | | | | | |
|---|---|---|---|---|---|---|---|---|---|---|---|---|---|---|---|
| | Fe | C | Cr | Co | Mo | V | Al* | Si | Mn | Mg | Ca | Ni | Ni+0.75 Co | Cr+Mo+V +Zr+Nb+W | Ni/Fe |
| 10 | 54.14 | 0.45 | 2.08 | 13.9 | 1.0 | 0.43 | — | — | — | — | — | 28 | 38.43 | 3.51 | 0.52 |
| 11 | 53.88 | 0.55 | 1.93 | 13.59 | 1.07 | 0.44 | 0.15 | 0.16 | 0.32 | — | 0.01 | 27.9 | 38.09 | 3.44 | 0.52 |
| 12 | 53.21 | 0.94 | 2.10 | 13.8 | 1.08 | 0.43 | — | 0.14 | 0.26 | 0.042 | — | 28.0 | 38.4 | 3.61 | 0.53 |
| 13 | 52.42 | 1.30 | 2.11 | 13.9 | 1.03 | 0.46 | — | 0.19 | 0.29 | — | — | 28.3 | 38.73 | 3.60 | 0.54 |
| 14 | 52.62 | 2.5** | 2.1 | 13.65 | 1.10 | 0.53 | — | 0.29 | 0.31 | — | — | 26.9 | 37.14 | 3.73 | 0.51 |
| 15 | 55.06 | 0.545 | — | 13.79 | 1.09 | 0.42 | 0.15 | 0.10 | 0.32 | — | 0.02 | 28.5 | 38.84 | 1.51 | 0.52 |

| Alloy | 0.2% Proof Stress (N/mm²) | Expansion Coefficient ( × $10^6$/°C) | | | | | | |
|---|---|---|---|---|---|---|---|---|
| | | 20–100°C | 20–200°C | 20–300°C | 20–350°C | 20–400°C | 20–500°C | 20–600°C |
| 10 | 249 | N.D. | N.D. | N.D. | 5.9 | N.D. | N.D. | N.D. |
| 11 | 290 | 4.45 | 4.4 | 4.6 | 5.4 | 6.5 | 8.6 | 9.5 |
| 12 | 283 | N.D. | N.D. | N.D. | 5.7 | N.D. | N.D. | N.D. |
| 13 | 259 | N.D. | N.D. | N.D. | 6.1 | N.D. | N.D. | N.D. |
| 14 | 247 | N.D. | N.D. | N.D. | 6.7 | N.D. | N.D. | N.D. |
| 15 | 271 | 4.1 | 3.9 | 3.9 | 4.1 | 5.1 | 7.2 | 8.8 |

*Nominal Al addition
**Nominal C addition
— NO ADDITION OF ELEMENT AND NO ANALYSIS MADE
N.D. = Not determined It can be seen from the results in Table 4 that as the carbon content was increased up to 0.55% there was an initial increase in 0.2% Proof Stress. As the carbon content was increased up to 0.55% there was an initial decrease in the thermal expansion coefficient and as the carbon content was increased above 0.55% there was an increase in thermal expansion coefficient. The amount of carbon for optimum Proof Stress and expansion properties is generally associated with the amount of carbide forming elements present and will vary to some extent from the value of 0.55% with variation of the amount of carbide forming elements present. However alloys to be used for castings according to the invention do not contain more than about 2.5% carbon and preferably the carbon content should not exceed about 1% e.g. 0.6%. More preferably the carbon content should be in the range of about 0.45 to about 0.55%, e.g. 0.5%.

It can also be seen from a comparison of the results of Alloy 11 and Alloy 15 in Table 4 that increasing the chromium content at a fixed carbon content, i.e. approximately 0.5% carbon, increased the 0.2% Proof Stress. However increasing the chromium content also increased the expansion coefficient and hence to achieve a balance the chromium content in alloys used for castings according to the invention does not exceed 3%, e.g. 2%. Preferably the chromium content is at least about 0.1%, and advantageously at least about 0.5%, but preferably not greater than about 1%, e.g., 0.75%. For lower proof stress and low expansion coefficient requirements chromium may be omitted.

As can be seen from comparison of the Alloy 11 and Alloy 12 results in Table 4 increasing both the carbon and chromium contents together can have the effect of lowering the 0.2% Proof Stress. For this reason when both carbon and chromium are present the carbon content preferably should not exceed about 0.55% and the chromium content preferably should not exceed about 1%.

The effect of the heat treatment conditions on an alloy similar to Alloy 15 of Table 4 can be seen from the results of the following Example 4.

TABLE 5

| Heat Treatment | 0.2% Proof Stress ($N/mm^2$) | Expansion Coefficient ( $\times 10^6/°C$) | | | | | | |
|---|---|---|---|---|---|---|---|---|
| | | 20–100°C | 20–200°C | 20–300°C | 20–350°C | 20–400°C | 20–500°C | 20–600°C |
| As Cast | 205 | 5.5 | 4.9 | 4.9 | 5.3 | 6.3 | 8.2 | 9.8 |
| 4h/700°C | | 4.1 | 4.0 | 4.1 | 4.7 | 5.9 | 7.9 | 9.4 |
| 8h/700°C | | 4.1 | 4.0 | 4.0 | 4.7 | 5.8 | 7.9 | 9.4 |
| 24h/700°C | 262 | 3.9 | 3.7 | 3.8 | 4.5 | 5.7 | 7.8 | 9.4 |
| 2h/750°C | | 4.6 | 4.1 | 4.1 | 4.7 | 5.9 | 7.8 | 9.4 |
| 4h/750°C | 250 | 4.6 | 4.3 | 4.3 | 4.9 | 6.0 | 8.0 | 9.5 |
| 8h/750°C | | 3.5 | 3.6 | 3.8 | 4.5 | 5.7 | 7.7 | 9.3 |

$N/mm^2$ = Newtons per square millimeter
h = hours

EXAMPLE 4

Alloy 16 suitable for use for a casting according to the invention, containing 28% nickel, 13.8% cobalt, 0.55% carbon, 0.79% chromium, 1.0% molybdenum, 0.5% vanadium, 0.22% silicon, 0.29% manganese, 0.15% aluminim, 0.02% calcium, 54.68% iron, % Ni + 0.75 (% Co) = 38.35, Cr + Mo + V + Zr + Nb + W = 2.29, Ni/Fe = 0.51, was air melted from a charge of Swedish bar iron, electrolytic cobalt and pellet nickel. The melt was deoxidized by immersing a graphic rod therein until the boil had almost finished, followed by addition of silicon, carbon, and chromium. After clear melting, molybdenum, vanadium, ferro-manganese and aluminum were added and the final deoxidant calcium (0.05%) plunged into the melt immediately before casting. The melt was cast to 18 millimeter diameter bars and tensile specimens machined therefrom. The specimens were tested in tension at 500°C and in thermal expansion both in the as-cast condition and after heat treatment at various times in the range of 2 to 24 hours at temperatures in the range of from 700° to 750°C. Thermal expansion properties over different temperature ranges, and tensile strength properties for Alloy 16 after different heat treatments are given in the following Table 5.

It can be seen from the Table 5 results that the expansion coefficient for Alloy 16 was reduced by heat treatment and that the 0.2% Proof Stress was increased by heat treatment. Nevertheless even in the as-cast condition Alloy 16 had good high strength (205 $N/mm^2$) and low expansion properties in comparison with a conventional cast iron — 42% nickel alloy which only had a 0.2% Proof Stress at 500°C of about 50 $N/mm^2$ even after heat treatment. Table 5 also shows that castings according to the invention produced from Alloy 16 had when treated a proof stress greater than 200 $Nlmm^2$ and an expansion coefficient over the range 20° to 350°C not greater than $5 \times 10^{-6}/°C$.

Molybdenum has a similar effect on expansion to that of chromium but in general terms increases the proof stress more effectively than chromium as can be seen from the following Example 5.

EXAMPLE 5

Alloys 17 and 18 having compositions as shown in the following Table 6 were vacuum melted and vacuum cast to castings according to the invention. The castings were heat treated for 8 hours at 700°C, and tested for thermal expansion and in tension at 500°C for 0.2% Proof Stress with the results shown in the following Table 6.

TABLE 6

| Alloy | Composition (Weight %) | | | | | | | | | | | | | |
|---|---|---|---|---|---|---|---|---|---|---|---|---|---|---|
| | Fe | C | Cr | V | Mo | Si | Mn | Co | W | B | Ni | Ni+ 0.75(Co) | Cr+Mo+V +Zr+Nb+W | Ni/Fe |
| 17 | 56.37 | 0.57 | 1.15 | 0.34 | — | 0.5 | 0.34 | 8.81 | 1.07 | 0.15 | 50.7 | 37.3 | 2.56 | 0.55 |
| 18 | 55.84 | 0.45 | 2.08 | 0.43 | 1.00 | — | — | — | — | — | 40.2 | 40.2 | 3.51 | 0.72 |

| Alloy | 0.2% Proof Stress ($N/mm^2$) | Expansion Coefficient ( $\times 10^6/°C$) | | | | | | |
|---|---|---|---|---|---|---|---|---|
| | | 20–100°C | 20–200°C | 20–300°C | 20–350°C | 20–400°C | 20–500°C | 20–600°C |
| 17 | 221 | 5.1 | 5.2 | 5.5 | 6.1 | 7.3 | 9.1 | 10.4 |
| 18 | 249 | 6.6 | 6.5 | 6.7 | 7.4 | 8.4 | 10.0 | 11.1 |

— NO ADDITION OF ELEMENT AND NO ANALYSIS

It can be seen from the results of Table 6 that increasing molybdenum content increased the 0.2% Proof Stress but also increased the expansion coefficient. Thus the molybdenum content in alloys used for castings according to the invention does not exceed about 3%, and for optimum proof stress and expansion properties preferably should not exceed about 2%, and more preferably should be in the range of about 0.8 to about 1.2%, e.g. 1%.

Vanadium has a strong effect on the proof stress and expansion coefficient of alloys suitable for castings according to the invention as can be seen from the results of the following Example 6.

EXAMPLE 6

Alloys 19 and 20 having compositions as shown in the following Table 7 were air-melted and air-cast to castings according to the invention using the procedure of Example 4, heat treated for 24 hours at 700°C and tested for tensile properties at 500°C and for expansion properties with the results shown in the following Table 7 which also repeats for comparison the results of Alloy 15.

TABLE 7

| Alloy | Composition (Weight %) | | | | | | | | | | | | |
|---|---|---|---|---|---|---|---|---|---|---|---|---|---|
| | | Fe | C | Cr | Co | Mo | V | Al* | Si | Mn | Ca | Ni | Cr+Mo+V Ni+0.75 Co | Ni/Fe +Zr+Nb+W |
| 15 | 55.06 | 0.545 | — | 13.79 | 1.09 | 0.42 | 0.15 | 0.10 | 0.32 | 0.02 | 28.5 | 38.84 | 1.51 | 0.52 |
| 19 | 56.13 | 0.54 | — | 13.63 | 1.12 | 0.72 | 0.15 | 0.20 | 0.29 | 0.02 | 27.2 | 37.43 | 1.84 | 0.49 |
| 20 | 56.59 | 0.54 | — | 13.42 | 1.10 | 0.98 | 0.15 | 0.23 | 0.28 | 0.01 | 26.7 | 36.75 | 2.08 | 0.47 |

| Alloy | 0.2% Proof Stress (N/mm²) | Expansion Coefficient ( × 10⁶/°C) | | | | | | |
|---|---|---|---|---|---|---|---|---|
| | | 20–100°C | 20–200°C | 20–300°C | 20–350°C | 20–400°C | 20–500°C | 20–600°C |
| 15 | 271 | 4.1 | 3.9 | 3.9 | 4.1 | 5.1 | 7.2 | 8.8 |
| 19 | 247 | 3.4 | 3.2 | 3.3 | 4.2 | 5.5 | 7.65 | N.D. |
| 20 | 234 | N.D. | N.D. | N.D. | N.D. | N.D. | N.D. | N.D. |

*Nominal Al addition
—NO ADDITION OF ELEMENT AND NO ANALYSIS
N.D. = Not determined From a comparison of the test results for Alloys 15, 19 and 20 in Table 7 it can be seen that high vanadium content reduces the 0.2% Proof Stress and increases the expansion coefficient. Thus in alloys made for castings according to the invention the vanadium content must not exceed about 1.2%, and is preferably less than about 1%. A small amount of vanadium does improve the 0.2% Proof Stress as can be seen by comparing the 0.2% Proof Stress of 271 N/mm² of Alloy 15 with the 0.2% Proof Stress of 207 N/mm² obtained at 500°C for a vanadium-free nickel-iron-cobalt alloy containing 35% nickel, 13.5% cobalt, 0.58% carbon, 2.31% chromium and 48.61% iron after casting and heat treatment for 8 hours at 700°C. For optimum proof stress and expansion coefficient properties the vanadium content should be between about 0.2 and about 0.4 or 0.6%, e.g. about 0.5%, particularly for alloys with about 0.5% carbon.

As aforesaid the total quantity of chromium, molybdenum, vanadium, zirconium, niobium and tungsten in alloys from which castings according to the invention are made must not be less than about 1% and must not be greater than about 4%. Inclusion of zirconium, niobium and/or tungsten may lead to a deterioration in some properties and for some uses should be excluded. If the sum of Cr + Mo + V + Zr + Nb + W is less than about 1% the proof stress and expansion properties do not show any significant improvement over conventional nickel-iron alloys, and if the sum of these elements exceeds about 4% the expansion coefficient is undesirably increased.

A further example of a casting according to this invention is given in Example 7.

EXAMPLE 7

An Alloy 21 containing, apart from impurities, 26% nickel, 14.5% cobalt, 0.47% carbon, 1.97% chromium, 1.01% molybdenum, 0.49% vanadium, 55.56% iron, % Ni + 0.75 (% Co) = 36.86, Cr + Mo + V + Zr + Nb + W = 3.47, Ni/Fe = 0.47 was vacuum melted and vacuum cast to a casting according to the invention. The casting was heat treated for 8 hours at 700°C and tensile tested at 500°C and tested in thermal expansion over various temperature ranges with the results shown in Table 8.

TABLE 8

| 0.2% Proof Stress (N/mm²) | Expansion Coefficient ( × 10⁶/°C) | | | | | | |
|---|---|---|---|---|---|---|---|
| | 20–100°C | 20–200°C | 20–300°C | 20–350°C | 20–400°C | 20–500°C | 20–600°C |
| 256 | 4.3 | 4.1 | 4.7 | 5.8 | 7.0 | 8.9 | 10.3 |

It can be seen from the results of Table 8 that a casting according to the invention from Alloy 21, has when heat treated, a 0.2% Proof Stress at 500°C greater than 200 N/mm² and a coefficient of thermal expansion over the temperature range 20° to 350°C not greater than $6.5 \times 10^{-6}$/°C.

Castings according to the invention may be made from alloys melted and cast in air or from alloys melted and cast under reduced pressures. Under air melting and casting conditions the quantities of the deoxidants silicon, calcium, aluminum, manganese, zirconium and/or magnesium used are important.

Silicon in alloys used for castings according to the invention renders the alloy more readily castable in air. More than about 0.5% silicon increases the proof stress but greatly increases the expansion coefficient. Hence for optimum proof stress and expansion properties the silicon content must not exceed about 0.5% and preferably should be kept as low as possible, e.g. not more than about 0.3%.

Calcium prevents gas evolution on casting and in alloys used for castings according to the invention the presence of up to about 0.05% calcium, e.g. about 0.02 to about 0.05% calcium is beneficial.

Aluminum facilitates the production of sound castings by the air melting and casting route but must not be present in quantities greater than 0.5% otherwise it increases the expansion coefficient. Preferably the aluminum content should not exceed about 0.3%, e.g. about 0.25% or 0.2% and should not be less than about 0.1%.

Manganese also facilitates deoxidation, castability and proof stress but at the expense of increased expansion and for this reason the manganese content must not exceed about 2% and for optimum proof stress and expansion properties preferably should not exceed about 0.6% and more preferably should not exceed about 0.3%.

Zirconium increases the proof stress and prevents gas evolution on casting under pressure but also increases the expansion coefficient. For this reason in alloys used for castings according to the invention the zirconium content does not exceed 2% and for optimum strength and expansion porperties preferably should not exceed 0.2%.

Magnesium is useful to prevent gas evolution on casting at pressures down to 2 millimetres and for this purpose should preferably be present in quantities not greater than 0.1%. This quantity has no effect on the proof stress and expansion properties. The magnesium also has the effect of promoting spheroidisation of graphite which may form in the casting during solidification or subsequent heat treatment. If such graphite were to form as flakes or films the casting may be embrittled but spheroidal graphite does not cause such embrittlement.

If the alloy is melted in vacuum magnesium and calcium spheroidising additions may be lost due to their volatile nature. Thus under vacuum melting conditions up to 0.2% of one or more of yttrium, lanthanum and the lathanides should preferably be present to promote graphite spheroidisation. Mischmetal (60% cerium, 35% lanthanum, 5% rare earths) is a convenient additive for this purpose.

Alloys of the invention are particularly useful for structural components which reach high temperatures in service, and must have a combination of low expansivity and high strength at working temperatures. Such structural components include parts of rotating and reciprocating machinery, e.g. turbine shafts and blades, in which close dimensional tolerances have to be maintained under varying temperature conditions from ambient temperatures up to 300°C or even higher, for example up to 500°C or 600°C. These requirements arise in a particularly acute form in high-efficiency propulsion machinery for land, sea and air use.

Castings according to the present invention are particularly useful for such high-efficiency propulsion machinery operating at temperatures in the range of 200° to 600°C and service speeds of the order of 9000 rpm or even higher.

Alloys of the present invention are especially useful as precision cast machine parts, e.g. a rotor or rotor blades for supercharging an internal combustion engine. It has been found that the present alloys maintain dimensional stability when used for adjoining thick and thin sections which must be resistant to hot tearing at the junctures when subjected in use to high centrifugal stresses, thermal cycling and temperature gradients. The temperatures may range from ambient to about 500° to 600°C. It has also been found that the present alloys can withstand such treatment in the presence, simultaneously, of oxidizing and hydrocarbon combustion product atmospheres.

Thus, in addition to having suitable properties of expansivity and strength, which are vital for efficiency of rotor blades, the present alloys satisfy the requirements of good castability and resistance to the complex and dynamic environment.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

What is claimed is:

1. A process for treating a cast low expansion carbidic alloy consisting essentially of, by weight, from about 21 to about 43% nickel, up to about 18% cobalt, from about 0.3 to about 1% carbon, up to about 3% chromium, from about 0.2 to about 1.2% vanadium, up to about 3% molybdenum, up to about 0.5% aluminum, up to about 0.5% silicon, up to about 2% manganese, up to about 290 zirconium, up to about 2% niobium, up to about 2% tungsten, up to about 0.1% magnesium, up to about 0.05% calcium and up to about 0.2% in total of elements of the group yttrium, lanthanum and lanthanides, with the provisos that the sum of the chromium, molybdenum, vanadium, zirconium, niobium and tungsten contents is in the range of from about 1 to about 4, the sum of % Ni + 0.75 (% Co) is 31.5 to 43 and the nickel to iron ratio is at least equal to 0.4:1, the balance, apart from impurities, being essentially iron, comprising subjecting the cast alloy directly to a temperature in the range of about 500° to about 900°C for a period of time in the range of from about 1 to about 24 hours to increase the strength and reduce the coefficient of thermal expansion of said alloy, said alloy having in the heat-treated condition a 0.2 proof stress at 500°C greater than 200 N/mm$^2$ and a coefficient of thermal expansion over the temperature range 20° to 250°C not greater than $6.5 \times 10^{-6}$/°C.

2. A process according to claim 1, wherein the cast alloy is subjected to a temperature in the range of about 600° to about 850°C.

3. A process according to claim 1, wherein the alloy has been air cast.

4. A process according to claim 1, wherein the chromium content is from about 0.1 to about 1%, and the maximum molybdenum content is about 2%, said cast alloy having in the heat-treated condition a 0.2% proof stress at 500°C greater than 200 N/mm$^2$ and a coefficient of thermal expansion over the temperature range 20° to 350°C not greater than $6.5 \times 10^{-6}$/°C.

5. A process according to claim 1, wherein the chromium contents is at least about 1%, and the maximum molybdenum content is about 2%.

* * * * *